US005284598A

United States Patent [19]

Subramanyam et al.

[11] Patent Number: 5,284,598

[45] Date of Patent: Feb. 8, 1994

[54] PROCESS FOR MAKING MILD, DETERGENT-SOAP, TOILET BARS AND THE BAR RESULTING THEREFROM

[75] Inventors: Ravi Subramanyam, North Brunswick; Liem D. Vu, Orange; Ben Gu, East Brunswick, all of N.J.

[73] Assignee: Colgate-Palmolive Company, Piscataway, N.J.

[21] Appl. No.: 802,160

[22] Filed: Dec. 4, 1991

[51] Int. Cl.[5] ..... C11D 9/32; C11D 17/00; C11D 1/12

[52] U.S. Cl. ..... 252/121; 252/122; 252/132; 252/134; 252/108; 252/162; 252/554; 252/DIG. 16

[58] Field of Search ..... 252/121, 122, 132, 134, 252/108, 162, 554, DIG. 16

[56] References Cited

U.S. PATENT DOCUMENTS

| | | | |
|---|---|---|---|
| 2,894,912 | 7/1959 | Geitz | 252/DIG. 16 |
| 3,376,229 | 4/1968 | Haass et al. | 252/DIG. 16 |
| 3,951,842 | 4/1976 | Prince et al. | 252/117 |
| 4,007,125 | 2/1977 | Prince | 252/117 |
| 4,180,470 | 12/1979 | Tokosh et al. | 252/121 |
| 4,201,743 | 5/1980 | Perla et al. | 264/148 |
| 4,268,424 | 5/1981 | Hall et al. | 252/546 |
| 4,612,136 | 9/1986 | Novakovic et al. | 252/134 |
| 4,663,070 | 5/1987 | Dobrovolny et al. | 252/121 |
| 4,673,525 | 6/1987 | Small et al. | 252/132 |
| 4,695,395 | 9/1987 | Caswell et al. | 252/121 |
| 4,696,767 | 9/1987 | Novakovic et al. | 252/557 |
| 4,707,288 | 11/1987 | Iriam et al. | 252/121 |
| 4,808,322 | 2/1989 | McLaughlin et al. | 252/121 |
| 4,812,253 | 3/1989 | Small et al. | 252/132 |
| 4,941,990 | 7/1990 | McLaughlin | 252/121 |
| 5,030,376 | 7/1991 | Lee et al. | 252/108 |
| 5,041,233 | 8/1991 | Kutny et al. | 252/121 |
| 5,096,608 | 3/1992 | Small et al. | 252/121 |

*Primary Examiner*—Anthony McFarlane
*Assistant Examiner*—Nhat D. Phan
*Attorney, Agent, or Firm*—Martin B. Barancik; Robert C. Sullivan

[57] ABSTRACT

An improved process for making a mild, detergent-soap, toilet bar containing a C6–C18 acyl isethionate as the principal surfactant in combination with minor proportions of C12–C20 fatty acids, a water soluble soap and water which comprises the step of forming a liquid mixture of said acyl isethionate, fatty acids and soap at a temperature of about 85° C. to 105° C. in the presence of about 0.5% to 2.5% by weight, based upon the bar, of vegetable oil prior to processing said liquid mixture on a chill roll to form particles which are further processed to yield said bar, said liquid mixture having reduced viscosity and being readily pumpable as compared to a liquid mixture prepared in the absence of said vegetable oil. The bar produced by the foregoing process also is part of the invention.

8 Claims, No Drawings

PROCESS FOR MAKING MILD, DETERGENT-SOAP, TOILET BARS AND THE BAR RESULTING THEREFROM

BACKGROUND OF THE INVENTION

1. Field of the Invention

The invention relates to an improved process for making a mild, detergent-soap, toilet bar containing, by weight, about 45% to 70% of sodium or potassium C6–C18 acyl isethionate, about 10% to 40% of C12–C20 fatty acids as a plasticizer and superfatting agent, about 3% to 25% of a water-soluble sodium or potassium soap and 2% to 10% of water which comprises the step of forming a liquid mixture of said isethionate, said fatty acids and said soap in the presence of from 0.5% to 2.5% by weight based upon the toilet bar of a vegetable oil at a temperature of from about 85° C. to 105° C. The liquid mixture formed in the presence of the vegetable oil has a reduced viscosity as compared with an identical mixture made without said vegetable oil and yields bars with improved slip, low isethionate degradation and low grit.

2. Description of the Prior Art

Mild, detergent-soap, toilet bars containing C6–C18 acyl isethionate as the principal detergent and minor amounts of fatty acids and soap are disclosed in U.S. Pat. No. 2,894,912 (Geitz) and U.S. Pat. No. 3,376,229 (Haass et al.). In Geitz, the chips processed into bars were produced from either a 40–50% aqueous slurry of the ingredients mixed at a temperature of from 38° C. to 93° C. or a mixture of the dry ingredients mixed at 100° C. for a long period of time. In Haass et al., the bars were prepared from a liquid mixture of acyl isethionate, fatty acids, anionic syudet and soap mixed at a temperature of about 110° C. to 113° C. for about fifteen minutes. The latter bars contained at least about 4% by weight of sodium isethionate as a processing aid.

In U.S. Pat. No. 4,707,288, mixtures of acyl isethionate, fatty acids, soap and more than 2% by weight of sodium isethionate were mixed in particulate form at temperatures in the range of 60° C. to 86° C. using a special cavity transfer mixer under conditions of high shear to yield toilet bars which exhibit reduced grit.

U.S. Pat. No. 4,696,767 discloses a process for making mild toilet bars wherein a slurry of acyl isethionate, water and a polyol such as sorbitol is formed into a stable solution by heating at a temperature of from 100° C. to 120° C. at 4–10 p.s.i.g. and said slurry is mixed with neat soap and this mixture is heated to about 150° C. under a pressure of 4 atmospheres before being spread on a chill roll to provide flakes which yield a toilet bar without grit. However, the presence of the polyol leads to increased water penetration in the soap dish as well as a bar of increased cost. This patent further teaches that use of acyl isethionate in particulate form causes problems—fine particles function as a lacrimatory agent and larger particles yield bars with grit.

In U.S. Pat. No. 4,663,070 a toilet bar composition in which soap is the principal surfactant is described. Liquid mixtures containing a major proportion of soap plus acyl isethionate, fatty acids, water and sodium isethionate were formed at temperatures of 96° C. to 103° C. In U.S. Pat. No. 5,030,376 a similar mixture containing a major proportion of soap is processed under conditions of high shear in a special cavity transfer mixer at temperatures maintained below 40° C. to form a mixture with some of the soap in the delta phase. U.S. Pat. No. 5,041,233 also relates to a similar mixture wherein a mixture of acyl isethionate, fatty acids and soap is prepared at a temperature of 82° C. to 94° C., with the soap being formed in situ. This patent indicates that high viscosity mixtures and hydrolysis of acyl isethionate can be problems in such mixtures.

The foregoing description of the prior art indicates that a variety of processes have been employed to produce mild, detergent-soap, toilet bars which have satisfactory hardness, water permeability, slip and low grit. Additionally, the resultant bars should exhibit low hydrolysis of the sodium isethionate. Also, desirably, the process should utilize standard equipment and should not require process temperatures higher than about 110° C. to avoid degradation of acyl isethionate and to conserve energy.

BRIEF DESCRIPTION OF THE INVENTION

The present invention relates to another process for preparing mild, detergent-soap, toilet bars containing, by weight, from 45% to 70% of sodium or potassium C6–C18 acyl isethionate, about 10% to 40% of C12–C20 fatty acids as a plasticizer and superfatting agent, about 3% to 25% of a water soluble C8–C20 soap and about 2% to 10% water which comprises the step of forming a liquid mixture of said acyl isethionate, fatty acids and soap at a temperature in the range of about 85° C. to 105° C. in the presence of about 0.5% to 2.5% by weight of a vegetable oil, said weight being based upon the toilet bar, prior to processing said liquid mixture on a chill roll to form particles, e.g., flakes which are further processed to yield said toilet bars, said liquid mixture having a reduced viscosity and being readily pumpable as compared to a liquid mixture prepared in the absence of said vegetable oil. Also included in the invention are the improved toilet bars produced by the foregoing process.

This process is an alternative process which overcomes many of the shortcomings of the prior art processes. For example, the inventive process yields substantially homogeneous, thin chips which result in bars with minimal grit. Also, the process is carried out at temperatures below 110° C. so as to minimize hydrolysis of the acyl isethionate and the process utilizes standard bar processing equipment. Further, the process conserves energy as compared with the prior art processes which employ temperatures above about 110° C. Additionally, the toilet bars resulting from the improved process have the desired hardness, water permeability, low grit and enhanced slip.

In one preferred aspect, the improved process comprises the steps of forming a liquid mixture of said isethionate, said fatty acids and at least about 50% by weight of the soap at a temperature of about 85° C. to 88° C., forming a liquid mixture of said vegetable oil and the balance of the soap, admixing said vegetable oil-soap mixture with said isethionate-fatty acids mixture with agitation while maintaining the temperature at 85° C. to 88° C. and continuing the agitation for from 5 to 15 minutes prior to processing the resultant mixture on the chill roll.

In another preferred aspect, the improved process comprises the steps of forming a liquid mixture of said isethionate and said fatty acids, forming a liquid mixture of said vegetable oil and said soap at a temperature above about 80° C., admixing the vegetable oil-soap mixture with the isethionate-fatty acids mixture with agitation at a temperature of about 99° C. to 105° C. and continuing said agitation while maintaining said temperature for up to twenty minutes prior to processing the resultant mixture on the chill roll.

As stated heretofore, the resultant bars exhibit the desired properties and are characterized by improved slip due to the presence of the vegetable oil which desirably is a mixture of palm oil and olive oil.

DETAILED DESCRIPTION OF THE INVENTION

The instant invention relates to an improved process of making mild, detergent-soap, toilet bars containing, by weight, about 45% to 70% of sodium or potassium C6 to C18 acyl isethionate, about 10% to 40% of C12–C20 fatty acids as a plasticizer and superfatting agent, about 3% to 25% of a water-soluble sodium or potassium C8–C20 soap and about 2% to 10% of water. Preferred toilet bars contain, by weight, about 45% to 60% of said acyl isethionate, about 15% to 30% of said fatty acids, about 10% to 20% of said soap and about 3% to 9% of water. While these bars can contain other ingredients, the bars are characterized by a major proportion of said acyl isethionate and minor proportions of fatty acids and soap, the ratio of acyl isethionate to fatty acids being about 7:1 to 1.1:1 and ratio of acyl isethionate to soap being about 23:1 to 1.8:1. These bar compositions are disclosed in the expired patent art such as U.S. Pat. Nos. 2,894,912 and 3,376,229 and the disclosures of these patents are incorporated herein by reference.

The improved process which is the subject of this invention is based upon the discovery that the incorporation of about 0.5% to about 2.5% of a vegetable oil into a mixture of alkali metal C6–C18 acyl isethionate, C12–C20 fatty acid, a water soluble sodium or potassium C8–C20 soap and water maintained at a temperature of from 85° C. to about 105° C. reduces the viscosity of the mixture and renders the mixture readily pumpable. Furthermore, the resultant bars made using the reduced viscosity mixture exhibit improved slip and post-washing skin feel. Generally, the mixture into which the vegetable oil is incorporated is prepared by melting the fatty acids and the acyl isethionate salt in flake form at a temperature in the range of 85° C. and 105° C. to form a substantially homogeneous liquid mixture which is mixed with neat soap thereafter. The proportions of each of the three components is chosen to result in the desired mild, detergent-soap, toilet bar.

In one preferred process, the molten mixture of the acyl isethionate and fatty acids is maintained at a temperature of from 85° C. to 88° C. and the water soluble soap is admixed therewith in two increments—about 75% by weight of soap being added initially and the remaining soap being added about 5 to 15 minutes later after it is mixed with the vegetable oil. In another preferred process, the temperature of the molten mixture of acyl isethionate and fatty acids is maintained in the range of about 99° C. to 105° C. prior to being admixed with a mixture of the neat soap and vegetable oil.

Suitable acyl isethionate salts contain 6 to 20, preferably 8 to 18, carbon atoms in the acyl group and the salt forming cation is sodium or potassium. These salts are prepared in a known manner by reacting a fatty acid with sodium or potassium isethionate or by reacting an acyl chloride such as cocoyl chloride or palmitoyl chloride with sodium or potassium isethionate. Preferably the fatty acyl isethionate should have an acyl group in which about 75% of the carbon atoms are in the range of 12 to 18. A particularly preferred salt is sodium cocoyl isethionate.

The acyl isethionate is available in particulate form, e.g. flakes, and the content of acyl isethionate is about 50% to 75% by weight. This particulate material contains minor amounts of unmodified reactants such as fatty acids and sodium or potassium isethionate. Typically, the concentration of fatty acids ranges from 20% to 45% by weight and the concentration of isethionate salt ranges from 1% to 4% by weight. Water also is usually present in the range of 0.5%% to 1.5%% by weight. The included quantity of isethionate salt does not adversely affect the resultant toilet bars and, in fact, may provide some desirable properties.

The C8–C20 aliphatic carboxylic acids serve as satisfactory binders and plasticizers in the mild, detergent-soap, toilet bars. Such acids may be saturated or unsaturated and have either straight or branched chains. Suitable acids include lauric acid, myristic acid, palmitic acid, stearic acid and mixtures thereof. A preferred binder plasticizer is a mixture of lauric acid and stearic and palmitic acid wherein about 60% to 80% by weight is the stearic and palmitic acid mixture. The aliphatic carboxylic acids are usually derived from naturally occurring oils and fats.

The water soluble soaps employed in the toilet bars are sodium or potassium salts of natural or synthetic aliphatic (alkanoic or alkenoic) acids having a carbon chain length of about 8 to 20 carbon atoms. Examples of triglyceride sources providing soaps with carbon chain lengths in this range include coconut oil, palm kernel oil, babassu oil, ouricuri oil, tallow, palm oil, rice bran oil, groundnut oil and rapeseed oil. Preferred soap mixtures are prepared from coconut oil and tallow and comprise about 50% to 90% by weight of tallow fatty acids and about 10% to 50% by weight of coconut oil fatty acids. Such mixtures contain more than 90% by weight of fatty acids having carbon chain lengths in the C12 to C18 range. The preferred mixtures contain some unsaturated soaps, but excessive unsaturation is typically avoided.

Soaps may be made by the classic kettle boiling process or fatty acid neutralization process or by more modern continuous soap manufacturing processes. These processes typically produce a neat soap containing from about 65% to 70% by weight of sodium soap, up to about 1.5% by weight of glycerine, up to about 1% by weight of salt, e.g., sodium chloride, and the balance water. Usually, neat soap is employed in the described inventive process. Neat soap required in the formula also can be made in the process by mixing soap chips containing 14–20% by weight of moisture and the necessary amount of water.

The oils utilized in the inventive process may be broadly classed as vegetable oils. Satisfactory oils include tropical nut oils such as palm oil, coconut oil and olive oil as well as non-tropical nut oils such as groundnut oil and rapeseed oil. Preferred oils are palm oil, olive oil and mixtures thereof. Such oils are used in proportion in the range of 0.5% to 2.5%, preferably 1.0% to 2.0%, by weight based upon the final detergent-soap bar.

The mild, detergent-soap, toilet bars can contain a variety of other ingredients. These include up to 10% by weight of other anionic detergents such as alkylbenzene sulfonates. alkyl sulfates and alkane sulfonates, up to 5% by weight of fillers such as starch and up to 5% by weight of salts such as sodium chloride and sodium isethionate. Further, up to 2.0% by weight of each of bactericidal agents, fluorescers, dyes or pigments, polymers and perfumes may be included where desired.

The resultant mild, detergent-soap, toilet bars are prepared by transferring the acyl isethionate, fatty acid, soap and oil homogeneous, pumpable slurry to a chilling roll where some of the moisture is flashed off and the mixture solidifies and is removed by a knife or scraper and pelletized or ground before being transferred to the amalgamator wherein the other ingredients such as the perfume, germicide, dye, etc., is incorporated. Thereafter the mixture is spread on a three or five roll mill from which it is removed in ribbons or flakes. The milled ribbons are compressed and extruded in a plodder to form a log of detergent-soap that is cut, optionally cooled and stamped to form bars or cakes.

The inventive process is characterized by the step of forming a liquid mixture of the acyl isethionate, fatty acids and soap at a temperature in the range of 85° C. to 105° C. in the presence of about 0.5% to 2.5% by weight, based upon the finished toilet bar composition, of a vegetable oil. Preferably, the vegetable oil will be a mixture of palm oil and olive oil, most preferably in a 1:1 weight ratio. Usually, the vegetable oil will be mixed with part or all of the added water-soluble soap prior to the admixture of said soap with the liquid mixture of acyl isethionate and fatty acids. However, if desired, the vegetable oil may be admixed with the mixture of acyl isethionate and fatty acids prior to admixture with the water soluble soap which normally is added as neat soap. Furthermore, usually the acyl isethionate will be added in the form of flakes which include some fatty acids and sodium or potassium isethionate salt in addition to said acyl isethionate.

In the most preferred process, the inventive process comprises the steps of forming a liquid mixture of said acyl isethionate and fatty acids at a temperature of about 85° C. to 88° C., admixing said isethionate-fatty acid mixture with more than 50% by weight of the added water soluble soap in the presence of agitation. The vegetable oil is admixed with the balance of the soap and said mixture is admixed with the foregoing mixture while maintaining the temperature in the range of 85° C. to 88° C.

The invention is illustrated in the following nonlimiting Examples. All proportions in the examples and elsewhere in the specification are by weight unless specifically stated otherwise.

EXAMPLE 1

Toilet bars A, B and C having the formulations set forth in Table I below are prepared.

TABLE I

| | Formulations | | |
|---|---|---|---|
| | A | B | C |
| Sodium cocoyl isethionate* | 47.801 | 47.323 | 46.845 |
| Coconut oil fatty acids | 5.592 | 5.536 | 5.480 |
| Stearic acid | 19.305 | 19.112 | 18.919 |
| Sodium tallow soap | 12.697 | 12.570 | 12.443 |
| Sodium coconut oil soap | 2.774 | 2.746 | 2.719 |
| Glycerine | 0.327 | 0.324 | 0.321 |
| Sodium chloride | 0.109 | 0.108 | 0.107 |
| Sodium isethionate | 1.985 | 1.965 | 1.945 |
| Sodium vinyl sulfonate | 1.985 | 1.965 | 1.945 |
| Water | 6.433 | 6.369 | 6.304 |
| Miscellaneous (a) | 0.992 | 0.982 | 0.972 |
| Palm oil | — | 0.500 | 1.000 |
| Olive oil | — | 0.500 | 1.000 |
| Total | 100.000 | 100.000 | 100.000 |

(a) Miscellaneous consists of color and perfume

*Added as a flake containing 66% of acyl isethionate, 30% fatty acids, 2% sodium isethionate, 1.5% water (all by wt.) In the preparation of each formulation, a Paterson mixer is preheated to a temperature of about 85° C. to 88° C. and the sodium cocoyl isethionate in the form of flakes and the stearic acid are charged into the mixer and melted therein in the presence of agitation.

Thereafter, 75% of the formula weight of neat soap--an aqueous mixture containing about 70% by weight of the sodium salt of a mixture of about 82% by weight of tallow fatty acids and 18% by weight of coconut oil fatty acids, about 1.5% by weight of glycerine, about 1% by weight of sodium chloride and the balance water--is mixed with the liquid mixture of stearic acid and sodium cocoyl isethionate with agitation.

After agitating for about 5 to 15 minutes, the balance of the neat soap amounting to 25% of the bar formula weight is added with agitation which is continued for from five to fifteen minutes while maintaining the temperature in the range of about 85° C. to 88° C. The resultant mixture is processed through a chill-roll mill to form flakes which are admixed with the miscellaneous ingredients in an amalgamator.

The mixture from the amalgamator is homogenized on a roll mill and processed through a plodder to form an extrusion which is cut and stamped into bars in a well known manner.

In the preparation of Formulation A, the mixture of neat soap, fatty acid and sodium cocoyl isethionate in the Paterson mixer has a heavy, dough-like consistency and is very difficult to pump. However, in the preparation of Formulations B and C, a 1:1 mixture of palm oil and olive oil—1% and 2% by weight respectively based upon the finished bar—is added along with the balance of the neat soap and the resultant mixture is more fluid and more easily pumpable. The mixture containing 2% by weight of the mixture of palm and olive oil is the most fluid. Furthermore, the bars corresponding to Formulations B and C exhibit improved slip and skin feel.

EXAMPLE 2

In order to further define the reduction in viscosity achieved by addition of the 1:1 mixture of palm oil and olive oil, a ten pound batch of the mixture of sodium cocoyl isethionate, fatty acids and neat soap of Formulation A above is prepared in a pilot plant Sigma mixer at a temperature in the range of 85° C. to 88° C. The dough-like mass is placed in a covered container and transferred into an oven where the temperature is increased to 106° C. Samples of the mixture are taken and incubated in water baths maintained at 88° C. and 99° C. respectively. A 1:1 mixture of palm oil and olive oil is added to some samples in concentrations of 1% by weight and 2% by weight respectively, said weights being based upon the final bar. The viscosity of the samples is measured using a Brookfield Viscometer (Model: HBTD, Serial #A05449) using spindle nos. 6 and 5 and the results are set forth in Table II which follows. The number 5 spindle is used on the compositions containing 2% by weight of the palm/olive oil mixture. Because the viscosity of the mixture is non-Newtonian, viscosities are measured at different rotational speeds.

TABLE II

| Rotational Speed (in RPM) | Viscosity (K centipoise) | | | | | |
|---|---|---|---|---|---|---|
| | w/o oil | | 1% oil | | 2% oil | |
| | 190° F. | 210° F. | 190° F. | 210° F. | 190° F. | 210° F. |
| 0.5 | 304.0 | 213.3 | 232.0 | 128.0 | 124.8 | 35.2 |
| 1.0 | 236.0 | 108.0 | 140.0 | 84.0 | 78.4 | 24.0 |
| 2.5 | 147.2 | 73.6 | 78.4 | 49.6 | 43.5 | 16.0 |
| 5.0 | 111.2 | 63.6 | 48.0 | 32.0 | 25.9 | 10.9 |
| 10 | 74.8 | 52.0 | 29.2 | 21.6 | 15.7 | 7.5 |
| 20 | 50.6 | 35.8 | 18.6 | 13.8 | 10.0 | 5.0 |
| 50 | 30.6 | 22.6 | 10.6 | 8.2 | 5.9 | 2.9 |

TABLE II-continued

| Rotational Speed (in RPM) | Viscosity (K centipoise) | | | | | |
|---|---|---|---|---|---|---|
| | w/o oil | | 1% oil | | 2% oil | |
| | 190° F. | 210° F. | 190° F. | 210° F. | 190° F. | 210° F. |
| 100 | 23.4 | 18.8 | 7.8 | 5.5 | 4.2 | 2.0 |

*RPM: Revolutions Per Minute

The viscosity results set forth in Table II clearly confirm that the incorporation of 1–2% by weight of the mixture of palm oil and olive oil into a mixture of sodium cocoyl isethionate, fatty acids and neat soap maintained at a temperature in the range of 88° C. to 99° C. reduces the viscosity of said mixture so that the mixture is easily pumpable. More specifically, at 88° C., the presence of 1% by weight of said oils on a finished bar basis reduces the viscosity by 60–70% in the presence of moderate agitation; and the presence of 2% by weight of oil reduces the viscosity by about 80%. Furthermore, in addition to improving the pumpability of the mixture, the slip properties of the resultant bars are improved.

EXAMPLE 3

When the process of Example 1 is repeated with the exceptions that the mixture is maintained at a temperature of 99° C. and 100% by weight of the neat soap is added to the mixture in the presence of 1–2% by weight of the 1:1 mixture of palm oil and olive oil, a substantial reduction in viscosity of the mixture is obtained and said mixture is easily pumped to the chill roll mill.

Similar results are obtained when coconut oil is substituted for the mixture of palm oil and olive oil and when mixtures of palm oil and olive oil in weight ratios of 1:4 and 4;1 are employed. Additionally, similar results are achieved using varying proportions of sodium cocoyl isethionate, fatty acids and neat soap within the ranges specified for the complete detergent-soap, toilet bars.

As indicated above, the invention has been described with respect to various specific embodiments, but it is not limited to said embodiments because one of ordinary skill in the art will be able to utilize substitutes and equivalents without departing from the invention taught by applicants.

What is claimed is:

1. An improved process for making a mild, detergent-soap, toilet bar containing, by weight, from 45% to 70% of sodium or potassium C6–C18 acyl isethionate, about 10% to 40% of C12–C20 fatty acids as a plasticizer and superfatting agent, about 3% to 25% of a water soluble C8–C20 soap and about 2% to 10% water which comprises the step of forming a liquid mixture of said acyl isethionate, fatty acids and soap by mixing said acyl isethionate, fatty acids, and soap at a temperature in the range of about 85° C. to 105° C. in the presence of about 0.5% to 2.5% by weight of a vegetable oil, said weight being based upon the toilet bar, processing said liquid mixture on a chill roll to form particles, processing said particles to yield said toilet bar, said liquid mixture having a reduced viscosity and being readily pumpable as compared to a liquid mixture prepared in the absence of said vegetable oil.

2. A process according to claim 1 which comprises the steps of mixing said isethionate with said fatty acids, admixing and agitating said vegetable oil with the isethionate-fatty acids mixture, admixing with agitation said soap with the foregoing mixture, and continuing said agitation for up to twenty minutes.

3. A process according to claim 1 which comprises the steps of mixing said isethionate with said fatty acids, forming a liquid mixture of said vegetable oil and said soap by mixing said vegetable oil with said soap at a temperature above about 80° C., admixing with agitation the vegetable oil-soap mixture with the isethionate-fatty acids mixture at a temperature of about 99° C. to 105° C., and continuing said agitation for up to twenty minutes.

4. A process according to claim 1 which comprises the steps of mixing said isethionate, said fatty acids and at least 50% by weight of the soap at a temperature of about 85° C. to 88° C., forming a liquid mixture of said vegetable oil and the balance of said soap by mixing said vegetable oil with the balance of said soap, and admixing with agitation said vegetable oil-soap mixture with said isethionate-fatty acids mixture at a temperature of 85° C. to 88° C., and continuing the agitation for 5 to 15 minutes.

5. A process according to claim 1 wherein said vegetable oil is a mixture of olive oil and palm oil.

6. A process according to claim 5 wherein said vegetable oil contains about equal parts of olive oil and palm oil.

7. A mild, detergent-soap, toilet bar which is formed from chips made by the process of claim 1.

8. A mild, detergent-soap, toilet bar which is formed from chips made by the process of claim 4.

* * * * *